US011124722B2

(12) United States Patent
Zard

(10) Patent No.: US 11,124,722 B2
(45) Date of Patent: Sep. 21, 2021

(54) METHOD FOR IMPROVING THE EMULSIFICATION PERFORMANCE OF NONIONIC ALKOXYLATED SURFACTANTS

(71) Applicant: PALOX LIMITED, Limassol (CY)

(72) Inventor: William A. Zard, Jal et Dib (LB)

(73) Assignee: PALOX LIMITED, Limassol (CY)

( * ) Notice: Subject to any disclaimer, the term of this patent is extended or adjusted under 35 U.S.C. 154(b) by 0 days.

(21) Appl. No.: 16/499,788

(22) PCT Filed: Apr. 3, 2018

(86) PCT No.: PCT/EP2018/058443
§ 371 (c)(1),
(2) Date: Sep. 30, 2019

(87) PCT Pub. No.: WO2018/178391
PCT Pub. Date: Oct. 4, 2018

(65) Prior Publication Data

US 2020/0102514 A1 Apr. 2, 2020

(30) Foreign Application Priority Data

Mar. 30, 2017 (GB) ..... 1705114

(51) Int. Cl.
*C10L 1/198* (2006.01)
*C10L 10/14* (2006.01)

(52) U.S. Cl.
CPC ..... *C10L 1/1985* (2013.01); *C10L 10/14* (2013.01); *C10L 2270/04* (2013.01); *C10L 2290/547* (2013.01)

(58) Field of Classification Search
CPC .... C10L 10/14; C10L 1/1985; C10L 2270/04; C10L 2290/547; C10L 2250/084; G02C 5/18
See application file for complete search history.

(56) References Cited

U.S. PATENT DOCUMENTS 4,770,670 A 9/1988 Hazbun et al.
5,069,817 A 12/1991 Schmid et al.
(Continued)

FOREIGN PATENT DOCUMENTS

EP 0758015 A1 2/1997
WO WO 2011/045334 A1 4/2011
(Continued)

OTHER PUBLICATIONS

International Search Report issued in PCT/EP2018/058443 (PCT/ISA/210), dated Jul. 18, 2018.
(Continued)

*Primary Examiner* — Latosha Hines
(74) *Attorney, Agent, or Firm* — Birch, Stewart, Kolasch & Birch, LLP

(57) ABSTRACT

A method of improving the emulsification performance of nonionic alkoxylated surfactants, for example when used as fuel additives. The method involves a) providing a composition comprising at least one nonionic alkoxylated surfactant; and b) prior to the addition of said composition to an aircraft fuel, thermally cycling said composition by (i) chilling the composition from a first temperature to a second temperature that causes metal ions and/or associated ions contained therein to precipitate as ionic salts; (ii) filtering the chilled composition to remove the precipitated ionic salts; and (iii) heating the filtered composition to the first temperature.

15 Claims, 2 Drawing Sheets

(56) References Cited

U.S. PATENT DOCUMENTS

| | | | | |
|---|---|---|---|---|
| 2003/0000131 | A1* | 1/2003 | Henry, Jr. ..... | C10L 1/224<br>44/437 |
| 2011/0258910 | A1* | 10/2011 | Siemssen ..... | C10L 1/026<br>44/307 |

FOREIGN PATENT DOCUMENTS

| | | | | |
|---|---|---|---|---|
| WO | WO 2011/095825 | A1 | 8/2011 | |
| WO | WO-2011095825 | A1 * | 8/2011 ..... | C10L 1/143 |

OTHER PUBLICATIONS

Written Opinion of the International Searching Authority issued in PCT/EP2018/058443 (PCT/ISA/237), dated Jul. 18, 2018.

* cited by examiner

METHOD FOR IMPROVING THE EMULSIFICATION PERFORMANCE OF NONIONIC ALKOXYLATED SURFACTANTS

FIELD OF THE INVENTION

The present invention relates to surfactants, more specifically improving the emulsification performance of nonionic alkoxylated surfactants, for example when used as fuel additives.

BACKGROUND OF THE INVENTION

The use of additives to improve the performance of jet fuel is well known and surfactants are commonly used as fuel additives or included in fuel additive systems.

International patent application WO 2007/083106 A1 discloses water-in-oil emulsions that contain emulsifying agents (e.g. betaines e.g. cocoamidopropyl betaine) and optionally $C_6$-$C_{15}$ alcohol ethoxylates and $C^6$-$C_{24}$ alkyl amide oxide. The emulsifying agents improve the physical stability of the oil by scavenging water (e.g. free water or dissolved water) in the fuel and/or inhibiting the growth of microorganisms in the fuel.

International patent applications WO 2011/095825 A1 and WO 2011/0445334 A1 disclose liquid concentrates and their use when added to liquid hydrocarbon fuel in forming stable water-in-oil-emulsions or water-in-oil-microemulsions that prevent or at least minimise the formation of ice and "apple jelly" in fuel that is cooled to temperatures in the range of from 0 to −50° C. "Apple jelly" is the term used in the industry to described the gel that the fuel additive diethylene glycol monomethyl ether (DiEGME) can form at low temperatures. The presence of ice or "apple jelly" in jet fuel can cause turbine engines to fail so it is critical avoid this. The liquid concentrate fuel additives disclosed in WO 2011/095825 A1 and WO 2011/0445334 A1 that solve this problem contain one or more amphoteric emulsifying agents, a mixture of nonionic alkoxylated surfactants, one or more glycol-based solubilizers and optionally one or more organic solvents. Preferred mixtures of nonionic alkoxylated surfactants include mixtures of certain $C_6$-$C_{15}$-alkanol ethoxylates.

United Kingdom patent GB 2463030 B discloses a method of determining the amount of particulate solids in a quantity of liquid hydrocarbon. The method involves i) obtaining a test sample of a liquid hydrocarbon from a larger quantity of liquid hydrocarbon, and ii) subjecting the test sample to a particulate solids analysis employing an automatic particle counter which uses a light blocking technique and determining the amount of particulate solids in said test sample. However prior to step ii) at least one surfactant that is both a) miscible or soluble with the liquid hydrocarbon and with water, and b) capable of distributing water into the liquid hydrocarbon to provide a stable clear water-in-oil microemulsion, is admixed with the liquid hydrocarbon in an amount such that any water present in the test sample which is subjected to particle solids analysis is distributed in the liquid hydrocarbon as a water-in oil microemulsion wherein the droplet size of the dispersed water phase is no greater than 0.25 μm. In certain embodiments the at least one surfactant is benzalkonium chloride (aka N-alkyl-N-benzyl-N,N-dimethylammonium chloride and alkyl-dimethylbenzylammonium chloride) or a mixture of surfactants comprising benzalkonium chloride and a $C_6$-$C_{15}$ alcohol ethoxylate, comprising from 2 to 12 EO (i.e. —$CH_2$—$CH_2$—O—) groups, or a mixture of such alcohol ethoxylates.

Nonionic alkoxylated surfactants and processes for manufacturing them are well known in the art. Some of these surfactants and processes are described by P. Hepworth in "Chapter 5: Non-ionic Surfactants" Chemistry and Technology of Surfactants, 2006, Blackwell Publishing, pages 133 to 139. Such methods typically produce residual metals ions, especially monovalent alkali metal ions such as potassium and sodium ions, which are innocuous for typical uses of nonionic alkoxylated surfactants.

The present inventor has surprisingly found that the presence of metals ions and/or associated ions in compositions of nonionic alkoxylated surfactants is detrimental to the emulsification performance of such surfactants as fuel additives and one can improve the emulsification performance of nonionic alkoxylated surfactants in fuel additives by removing these metal ions and/or associated ions or at least minimising their concentration. The present inventor has also surprisingly found that fuel additives containing nonionic alkoxylated surfactants that have been treated in this way more effectively prevent or at least minimise the formation of ice and "apple jelly" in fuel that is cooled to temperatures in the range of from 0 to −50° C.

STATEMENT OF THE INVENTION

In a first aspect, the present invention provides a method of improving the emulsification performance of nonionic alkoxylated surfactants, said method comprising, prior to the addition of said fuel additive composition to an aircraft fuel, the steps of:

a) providing a composition comprising at least one nonionic alkoxylated surfactant; and
b) thermally cycling said composition by (i) chilling the composition from a first temperature to a second temperature that causes metal ions and/or associated ions contained therein to precipitate as ionic salts; (ii) filtering the chilled composition to remove the precipitated ionic salts; and (iii) heating the filtered composition to the first temperature.

In a second aspect, the present invention provides the use of at least one nonionic alkoxylated surfactant in the preparation of a fuel additive system, wherein a composition containing said at least one nonionic alkoxylated surfactant has, prior to the addition of said composition to an aircraft fuel, been thermally cycled by (i) chilling the composition from a first temperature to a second temperature that causes metal ions and/or associated ions contained therein to precipitate as ionic salts; (ii) filtering the chilled composition to remove the precipitated ionic salts; and (iii) heating the filtered composition to the first temperature.

In a third aspect, the present invention provides at least one nonionic alkoxylated surfactant for use in the preparation of a fuel additive system, wherein a composition containing said at least one nonionic alkoxylated surfactant has, prior to the addition of said composition to an aircraft fuel, been thermally cycled by (i) chilling the composition from a first temperature to a second temperature that causes metal ions and/or associated ions contained therein to precipitate as ionic salts; (ii) filtering the chilled composition to remove the precipitated ionic salts; and (iii) heating the filtered composition to the first temperature.

Accordingly, the present invention is concerned with the removal of salt from the product prior to putting it in an aircraft as part of an additive package. The invention therefore allows the product to be "cleaned up" to meet the very strict guidelines concerning the amount of metal ions/salts present in aircraft fuel Preferably the at least one nonionic alkoxylated surfactant is at least one nonionic ethoxylated surfactant, preferably at least one $C_6$-$C_{15}$-alkanol ethoxylate.

Preferably the at least one nonionic alkoxylated surfactant is at least one nonionic alkoxylated surfactant selected from one or more of $C_6$-alkanol ethoxylates, $C_7$alkanol ethoxylates, a $C^8$-alkanol ethoxylates, $C_9$-alkanol ethoxylates, $C_{10}$-alkanol ethoxylates, $C_{11}$-alkanol ethoxylates, $C_{12}$-alkanol ethoxylates, $C_{13}$-alkanol ethoxylates, $C_{14}$-alkanol ethoxylates, and $C_{15}$-alkanol ethoxylates.

Preferably the at least one nonionic alkoxylated surfactant is one $C_6$-$C_{15}$-alkanol ethoxylate selected from $C_6$-alkanol ethoxylates, $C_7$alkanol ethoxylates, $C_8$-alkanol ethoxylates, $C_9$-alkanol ethoxylates, $C_{10}$-alkanol ethoxylates, $C_{11}$-alkanol ethoxylates, $C_{12}$-alkanol ethoxylates, $C_{13}$-alkanol ethoxylates, $C_{14}$-alkanol ethoxylates, and $C_{15}$-alkanol ethoxylates.

Preferably the at least one nonionic alkoxylated surfactant is a mixture of $C_6$-$C_{15}$-alkanol ethoxylates with different carbon numbers for the alkanol unit species and 2 to 5 moles of ethylene oxide units on average per mole of alkanol, wherein the carbon numbers for the two $C_6$-$C_{15}$-alkanol ethoxylates which have the highest share in weight in the mixture being at least 1.5 carbon numbers distant from each other, and wherein the carbon number for one of the two $C_6$-$C_{15}$-alkanol ethoxylates which have the highest share in weight in the mixture is in the range of 9 to 11 and the other is in the range of 12 to 14.

Preferably the thermal cycling comprises a plurality of cycles of heating and chilling.

Preferably the thermal cycling comprises from 2 to 5 cycles of heating and chilling, more preferably from 6 to 10 cycles of heating and chilling, even more preferably from 11 to 15 cycles of heating and chilling.

Preferably in step (b) the first temperature is ambient temperature or from 30° C. to 10° C.

Preferably in step (b) the second temperature is from 20° C. to −60° C., preferably from 10° C. to −40° C., and more preferably from 0° C. to −20° C.

Preferably in step (c) the chilled composition comprising at least one nonionic alkoxylated surfactant is filtered through a filter having a mesh size of less than 150 microns, preferably less than 25 microns, more preferably less than 10 microns.

TERMS

Terms used in the specification have the following meanings:

The term "associated ions" as used herein means any ion other than a metal ion that is typically associated with metal ions, for example any ion other than a metal ion that typically produced during the commercial manufacture of nonionic alkoxylated surfactants. Such associated ions will typically remain in some concentration in the nonionic alkoxylated surfactants or compositions of the nonionic alkoxylated surfactants and may precipitate from such compositions as ionic salts. Such associated ions may precipitate as ionic salts with metal ion salts. Associated ions typically include sulphate and chloride ions.

The term "chilling" as used herein means lowering the temperature thereof, typically from room temperature to below room temperature and often to below 0° C. Chilling can be achieved by various art-known methods and equipment.

The term "dissolved water" as used herein means water is dissolved in the liquid fuel phase. Dissolved water becomes free water with lower temperatures due to the reduction in solubility of the water in liquid fuel.

The term "emulsification performance" as used herein means the ability of a material to emulsify a given quantity of water in a given fuel. The lower the required quantity of emulsifier the higher the emulsion forming power. For example, one can measure the amount of fuel additive or fuel additive system required to emulsify 1% by volume of water as noted by forming a clear (i.e. transparent), bright (i.e. not hazy) microemulsion, using the water titration test protocol set out in the Examples.

The term "free water" as used herein means water present as a separate visible liquid phase in a two phase liquid fuel and water mixture.

The term "fuel", "liquid fuel" or "liquid hydrocarbon fuel" as used herein means a liquid hydrocarbon that is suitable for burning to power a combustion engine. A fuel in accordance with the present invention includes jet fuel, aviation gasoline, military grade fuel, biofuel, bioethanol, biodiesel, diesel; kerosene; gasoline/petrol (leaded or unleaded); paraffinic fuel, naphthenic fuel, heavy fuel oil, waste oils or such as esters, poly alpha olefin; and mixtures thereof. The fuel is preferably jet fuel, aviation gasoline, military grade fuel, biodiesel, bioethanol, diesel, kerosene or gasoline/petrol but especially jet fuel.

The term "fuel additive" as used herein means any substance that is added to a fuel into order to impart certain properties to that fuel, for example to minimise the formation of ice in that fuel or to partition particulate solids e.g. rust and dust particles from water in the fuel.

The term "fuel additive system" as used herein means any mixture of substances that is added to a fuel into order to impart certain properties to that fuel, for example to minimise the formation of ice in that fuel or to partition particulate solids e.g. rust and dust particles from water in the fuel.

The term "liquid fuel which is immiscible with water" as used herein means in relation to a liquid fuel, that is not miscible with water at greater than about 0.1% water, preferably at greater than 0.05%, i.e. any admixture of liquid fuel and water above 0.05% separates out on standing in to two phases.

The term "metal ions" as used herein means any ion of any metal. Preferably the metal ions are those produced during the commercial manufacture of nonionic alkoxylated surfactants, for example monovalent alkali metal ions, especially potassium and sodium ions. Such metal ions will typically remain in some concentration in the nonionic alkoxylated surfactants or compositions of the nonionic alkoxylated surfactants and may precipitate from such compositions as ionic salts. Such metal ions are typically associated with other ions such as sulphate and chloride ions and those ions may also precipitate as ionic salts with the metal ion salts.

The term "nonionic alkoxylated surfactant" as used herein means a nonionic surfactant that includes one or more alkoxy groups. Preferred nonionic alkoxylated surfactants are nonionic ethoxylated surfactants, more preferably $C_6$-$C_{15}$-alkanol ethoxylates (aka $C_6$-$C_{15}$-alcohol ethoxylates). Where a surfactant compound is "ethoxylated", this generally means it includes at least two ethoxy (EO) groups. Preferably ethoxylated surfactant compounds comprise from 2 to 12 EO groups.

The term "nonionic surfactant" as used herein means a surfactant or surface agent that has no ionisable polar end groups. Such surfactants generally have hydrophilic and lipophilic segments.

The term "scavenge" as used herein means to act as a scavenger, as defined below.

The term "scavenger" as used herein means a substance added to a chemical reaction or mixture to counteract the effect of impurities, as defined in Collins English Dictionary, Fourth Edition 1998, Reprinted 1999 (twice), HarperCollins Publishers. In the context of the present invention it means to draw water (e.g. free water or dissolved water) from liquid hydrocarbon fuel into the water phase of a water-in-oil emulsion or water-in-oil microemulsion that is formed within liquid hydrocarbon fuel into which a liquid concentrate comprising at least one surfactant has been added.

The term "surfactant" or as used herein means any suitable surfactant or mixture of surfactants, which is capable upon simple admixture with a mixture comprising two immiscible phases of a liquid fuel and water of forming a water-in-oil-emulsion or water-in-oil-microemulsion. Formation of the emulsion or microemulsion is substantially spontaneous upon the addition at ambient temperature (e.g. 10-30° C.) of the surfactant(s) to a mixture comprising two immiscible phases of a liquid fuel and water.

The term "thermally cycling" as used herein means alternately heating and chilling/cooling of a substance. Thermal cycling preferably comprises a plurality of cycles of heating and chilling, for example 2 cycles, 3 cycles, 4 cycles, 5 cycles, 10 cycles, 15 or more cycles.

Other than in the operating examples, or where otherwise indicated, all numbers expressing quantities of ingredients used herein are to be understood as modified in all instances by the term "about".

Unless specified to the contrary, "water" as used herein means free water or dissolved water.

Throughout this specification and in the claims that follow, unless the context requires otherwise, the word "comprise" or variations such as "comprises" and "comprising", will be understood to imply the inclusion of a stated integer or group of integers but not the exclusion of any other stated integer or group of integers.

DESCRIPTION OF THE DRAWINGS

The present application includes FIGS. 1 to 7. In the drawings.

DETAILED DESCRIPTION OF THE INVENTION

Figure 1:
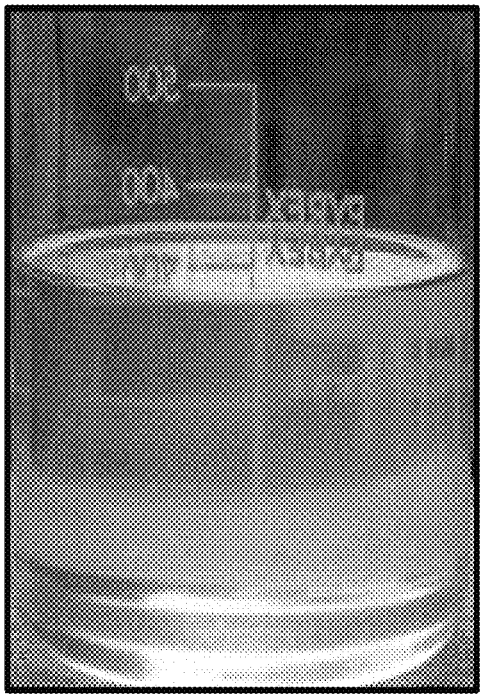
FIG. 1 shows pre-filtered SURFAC™ UN30 surfactant (see Example 1).

The present invention provides a method for improving the emulsification performance of nonionic alkoxylated surfactants, for example when used as fuel additives.

Liquid hydrocarbon fuel, especially jet fuel, can be contaminated in a fuel tank of a turbine engine aircraft with small quantities of water from condensation arising from the changes in temperature due to altitude changes. On the ground the fuel/tank temperature can range from about −20° C. to +50° C. (depending on location), whilst in flight it typically ranges from −22° C. to −39° C. It is believed a Boeing 777 aircraft lost sufficient power to cause an emergency landing at Heathrow in January 2008 due to the formation of ice reducing the flow of fuel from the fuel tanks to the engines (AAIB interim report No 2 G-YMMM).

Water exists in fuel as either free water or dissolved water. The term "free water" refers to water present as a separate visible liquid phase in a two phase liquid fuel and water mixture, while the term "dissolved water" refers to water that is dissolved in the liquid fuel phase. This may arise from entrained water or water that is dissolved in the liquid fuel phase. Dissolved water becomes free water with lower temperatures due to the reduction in solubility of the water in liquid fuel.

Such free water exists in or is introduced into the liquid fuel as a contaminant i.e. it is not water, which has been deliberately added to the liquid fuel, such as water, added to a liquid fuel in the preparation of a water-in-oil emulsion or microemulsion. The free water exists or is introduced as a contaminant in the liquid fuel or water when e.g. water is added to the liquid fuel accidentally or inadvertently, or the water is ambient moisture such as from rain or condensation water derived from changes in humidity levels in the atmosphere whilst the liquid fuel is in a tank vented to atmospheric conditions or in a tank subject to wide temperature changes such as that on an aircraft.

Whilst in extreme conditions the amount of free water which may be introduced as a contaminant could comprise 0.5% by weight or more of the combined weight of water and liquid fuel, it will be apparent to those skilled in the art that in practice the amount of free water contaminant will typically comprise significantly less than 0.5 wt % of the combined weight of free water and liquid fuel. For example, typically the amount of free water contaminating the liquid fuel will be less than 0.2 wt % and more typically less than 0.1 wt %, such as 0.05 wt % or less, by weight of the combined weight of water and liquid fuel.

Diethylene glycol monomethyl ether (DiEGME) is often added to fuel, especially jet fuel, to minimise the formation of ice in the fuel. However DiEGME is known to form a gel at low temperatures that is commonly known in the industry as "apple jelly". The formation of apple jelly in jet fuel has been attributed to causing several aviation accidents.

Nonionic alkoxylated surfactants are useful in fuel additives, especially in fuel additive systems that are known to prevent or at least minimise the formation of ice and "apple jelly" in fuel, especially jet fuel cooled to temperatures in the range of from 0 to −50° C., for example during storage before on during flight. International patent applications WO 2011/095825 A1 and WO 2011/0445334 A1 disclose such fuel additive systems that include nonionic alkoxylated surfactants.

Nonionic alkoxylated surfactants are also useful in fuel additives systems that are known to partition particulate solids, e.g. rust and dust particles, from water in the fuel. United Kingdom patent GB 2463030 B discloses such fuel additive systems that include nonionic alkoxylated surfactants.

The present inventor has used water filtration test to check the functionality of such fuel additives and fuel additive systems. In the test the amount of fuel additive or fuel additive system required to emulsify 1% by volume of water, by forming a clear bright microemulsion, was measured. Although the actual treat rates of these additive systems are of the order of parts per million (ppm) this test allows the emulsification potential of each system to be compared when using the same jet fuel. The lower the quantity of additive required, the more efficient the system.

Commercially available nonionic alkoxylated surfactants, especially alcohol ethoxylates, are manufactured using well-known techniques that produce residual metal ions, especially monovalent alkali metal ions e.g. potassium or sodium ions, and often associated ions such as sulphate and chloride ions. The manufacturers of those nonionic alkoxylated surfactants do not remove such ions as their products are often used in conjunction with ionic surfactants, for example in dish-washing cleaners where the presence of these ions, for example monovalent metal ions, is beneficial.

In order to meet stringent fuel regulations the addition of a fuel additive system must not increase the presence of these types of metal ions above certain limits. The use of standard commercially available alcohol ethoxylates does not adversely affect these metal ion concentration requirements. However, the present inventor has found that the presence of metal ions, particularly monovalent alkali metal ions, detrimentally affects the non-ionic emulsification process.

During routine testing of materials it had been noted on several occasions that when commercially available non-ionic alkoxylated surfactants, especially alcohol ethoxylate surfactants, have been subject to sub-zero temperatures solid material form in the additive system that once warmed up did not always get taken back into solution. Initially it was considered that this material was higher chain length by products formed in the production process. However as the material did not generally re-dissolve the present inventor postulated that the material may have resulted from contamination.

The present invention provides a method of improving the emulsification performance of nonionic alkoxylated surfactants, for example when used as fuel additives.

The first step, step a), of the method of the present invention comprises providing a composition comprising at least one nonionic alkoxylated surfactant.

Preferably the at least one nonionic alkoxylated surfactant is at least one nonionic ethoxylated surfactant, more preferably at least one $C_6$-$C_{15}$-alkanol ethoxylate.

Preferably the at least one nonionic alkoxylated surfactant is at least one $C_6$-$C_{15}$-alkanol ethoxylate is selected from one or more of $C_6$-alkanol ethoxylates, $C_7$alkanol ethoxylates, a $C_8$-alkanol ethoxylates, $C_9$-alkanol ethoxylates, $C_{10}$-alkanol ethoxylates, $C_{11}$-alkanol ethoxylates, $C_{12}$-alkanol ethoxylates, $C_{13}$-alkanol ethoxylates, $C_{14}$-alkanol ethoxylates, and $C_{15}$-alkanol ethoxylates. More preferably the at least one nonionic alkoxylated surfactant is at least one $C_6$-$C_{15}$-alkanol ethoxylate selected from $C_6$-alkanol ethoxylates, $C_7$alkanol ethoxylates, $C_8$-alkanol ethoxylates, $C_9$-alkanol ethoxylates, $C_{10}$-alkanol ethoxylates, $C_{11}$-alkanol ethoxylates, $C_{12}$-alkanol ethoxylates, $C_{13}$-alkanol ethoxylates, $C_{14}$-alkanol ethoxylates, and $C_{15}$-alkanol ethoxylates.

In certain embodiments the at least one nonionic alkoxylated surfactant is a mixture of $C_6$-$C_{15}$-alkanol ethoxylates. Preferably it is preferably a mixture of $C_9$-$C_{14}$ alcohol ethoxylates, such as a mixture of $C_9$ to $C_{11}$ alcohol ethoxylates or a mixture of $C_{12}$-$C_{14}$ alcohol ethoxylates. The distribution of any of the components in the mixture can range from 0 to 50% by weight, and are preferably distributed in a Gaussian format.

In certain embodiments the at least one nonionic alkoxylated surfactant is a mixture of $C_6$-$C_{15}$-alkanol ethoxylates with different carbon numbers for the alkanol unit species and 2 to 5 moles of ethylene oxide units on average per mole of alkanol, wherein the carbon numbers for the two $C_6$-$C_{15}$-alkanol ethoxylates which have the highest share in weight in the mixture being at least 1.5 carbon numbers distant from each other, and wherein the carbon number for one of the two $C_6$-$C_{15}$-alkanol ethoxylates which have the highest share in weight in the mixture is in the range of 9 to 11 and the other is in the range of 12 to 14.

Known nonionic alkoxylated surfactant products include SYNPERONIC™ brand surfactants from Croda including SYNPERONIC™ 91-2.5 surfactant, SURFAC™ brand surfactants from Surfachem including SURFAC™ UN30, and NEODOL™ brand surfactants from Shell such as NEODOL™ 91-6 surfactant.

The second step, step b), of the method of the present invention comprises thermally cycling said composition by (i) chilling the composition from a first temperature to a second temperature that causes metal ions and/or associated ions contained therein to precipitate as ionic salts; (ii) filtering the chilled composition to remove the precipitated ionic salts; and (iii) heating the filtered composition to the first temperature. As mentioned above, commercially available nonionic alkoxylated surfactants, especially alcohol ethoxylates, often contain metal ions, especially monovalent alkali metal ions, which are innocuous or sometimes advantageous to their typical uses. However the present applicant has found these metal ions, especially monovalent alkali metal ions such as potassium and sodium ions, are detrimental when formulating fuel additives so they should be removed from or at least their concentration should be minimised. These metal ions are typically associated with other ions such as sulphate and chloride ions. Those ions may also be detrimental when formulating fuel additives and may also precipitate as ionic salts with the metal ion salts.

Chilling a composition means lowering the temperature of that composition, typically from ambient temperature to below ambient temperature and often below 0° C.

This can be achieved by various art-known methods and equipment. For example chilling a composition means lowering the temperature of the composition by relocating it from one area that has a certain temperature to another area when temperature is lower than that of the first area, for example by moving a vessel containing the composition into a fridge or chiller. Alternatively, one can chill a composition by placing a cooling device within the composition.

The chilling needs to be sufficient in terms of temperature to cause all or substantially metal ions and/or associated ions contained in the composition to precipitate out of the composition as ionic salts. The rate by which the temperature of the composition is lowered will often determine when the metal ions and/or associated ions contained in the composition will form ionic salts and precipitate out of the composition as ion salts. One skilled in the art can readily determine the optimal chilling temperature for a given composition and a given environment. For example the ambient temperature in many parts of Australia will generally much higher than the ambient temperature of most parts of Norway.

The third step, step c), of the method of the present invention comprises filtering the chilled composition to remove the precipitated ionic salts.

The filtering can carried out using any suitable art-known filtering/filtration method. Preferably the filtering is performed at room temperature. Filtration can be carried out using any suitable art type of filter, for example a mesh filter. Preferably the chilled composition comprising at least one nonionic alkoxylated surfactant is filtered through a filter having a mesh size of less than 150 microns, preferably less than 25 microns, more preferably less than 10 microns, even more preferably less than 1 micron, or yet more preferably less than 0.45 microns.

Multiple filtration stages may be needed to obtain a desired filtration.

If desired, the concentration of metal ions and/or associated ions can be measured in the composition at any time before, during or after the method of the present invention is performed to verify the removal of metal ions and/or associated ions. Suitable methods for measuring the concentration of metal ions and/or associated ions in a compositions are well known in the art, for example Inductively Coupled Plasma Mass Spectrometry (ICP-MS) analysis.

If desired, the temperature of the filtered composition is raised to room temperature by any suitable means before it is used in the formulation of a fuel additive system, for example any of the fuel additive systems disclosed in the international patent applications WO 2011/095825 A1, WO 2011/0445334 A1 and WO 2013/150274 A2 or in United Kingdom patent GB 2463030 B.

Industrially, filtration can be performed in conjunction with the chilling step.

One skilled in the art would appreciate that the viscosity of a given nonionic alkoxylated surfactant will increase with decreasing temperature so for best results it is may be necessary to optimize the chilling temperature and the filtration mesh size.

Various modifications and variations of the described methods and uses of the present invention will be apparent to those skilled in the art. Although the invention has been described in connection with specific preferred embodiments, it should be understood that the invention as claimed should not be unduly limited to such specific embodiments.

EXAMPLES

The following Examples illustrate the method of the present invention:

Example 1

A commercial sample of SURFAC™ UN30 surfactant ($C_{9-11}$alcohol ethoxylate with 2.5 moles ethylene oxide available from Surfachem Group Ltd supplied as a 100% active liquid) was placed in a chiller to reduce its temperature to −5° C. and thermally cycled over 2 cycles. The resulting opaque additive system was then filtered using 1 micron glass fibre filter material. The resulting recovered fluid was then warmed to ambient temperature and used in the preparation of a fuel additive system (described in WO 2011/095825 A1 and WO 2011/0445334 A1).

FIG. 1 shows pre-filtered SURFAC™ UN30 surfactant.

Figure 2:
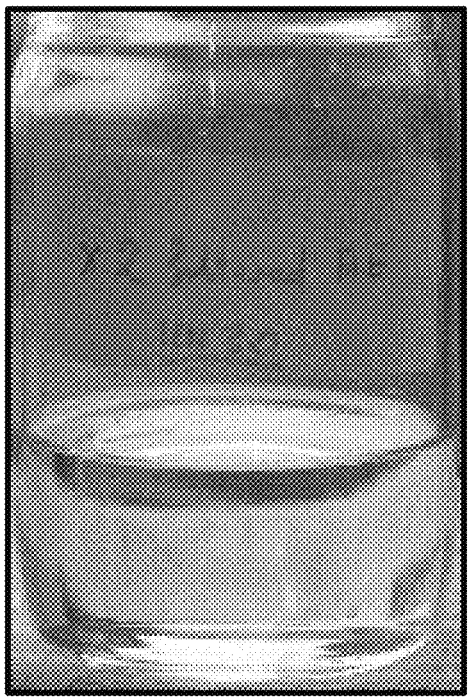
FIG. 2 shows the SURFAC™ UN30 surfactant composition after having been filtered through 1 micron glass fibre paper (see Example 1).

FIG. 2 shows the SURFAC™ UN30 surfactant composition after having been filtered through 1 micron glass fibre paper.

Example 2

The commercial sample of SURFAC™ UN30 surfactant prepared in Example 1 was used in a fuel additive system noted in Example 1. It was tested using the 1% volume water titration test (described below). This was compared to an additive system from Example 1 using a SURFAC™ UN30 that was not thermally cycled and filtered.

The additive system using the thermally cycled SURFAC™ UN30 alcohol ethoxylate reduced the quantity of additive required by 10% volume.

Example 3

A commercial sample of SYNPERONIC™ 91-2.5 surfactant ($C_{9-11}$alcohol ethoxylate with 2.5 moles ethylene oxide available from Croda Ltd supplied as a 100% active liquid) was thermally cycled from −23° C. to ambient over 10 cycles. The resulting fluid was then passed through a 0.45 micron filter membrane at 23° C. The resulting recovered liquid was used to prepare a fuel additive system per Example 1.

Figure 3:
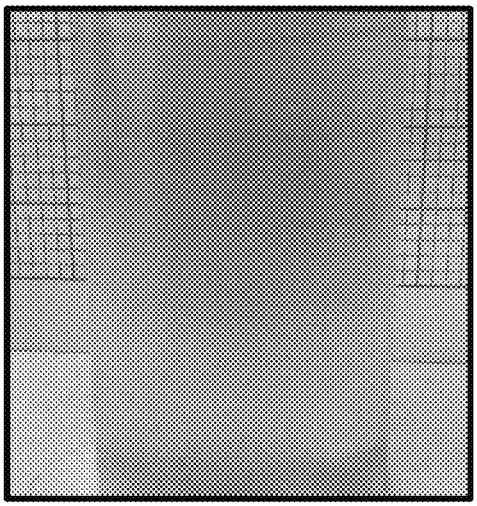
FIG. 3 shows pre-filtered SYNPERONIC™ 91-2.5 surfactant (see Example 3).

FIG. 3 shows pre-filtered SYNPERONIC™ 91-2.5 surfactant. The solution is hazy.

Figure 4:
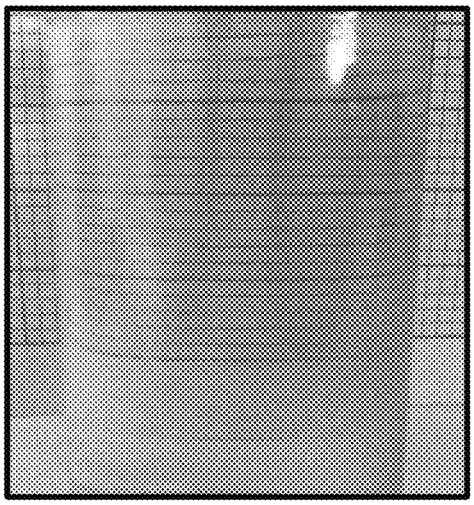
FIG. 4 shows the SYNPERONIC™ 91-2.5 surfactant composition after having been filtered through the 0.45 micron filter membrane (see Example 3).

FIG. 4 shows the SYNPERONIC™ 91-2.5 surfactant composition after having been filtered through the 0.45 micron filter membrane. The solution is clear/transparent.

Example 4

The additive system prepared in Example 3 was tested using the 1% volume water titration test and compared to an additive system from Example 3 using a version of the SYNPERONIC™ 91-2.5 surfactant that was not thermally cycled and filtered.

The additive system using the thermally cycled SYNPERONIC™ 91-2.5 alcohol ethoxylate reduced the quantity of additive required by 10.2% volume.

Figure 5:
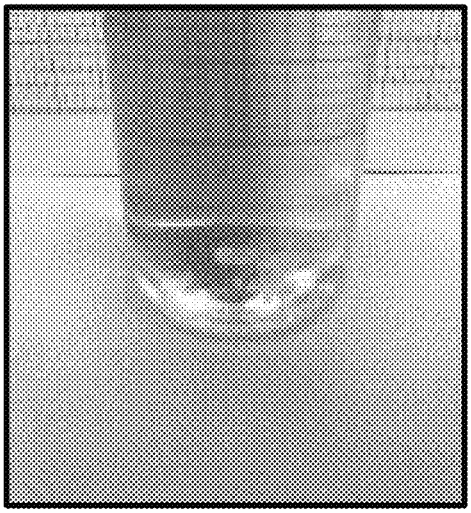
FIG. 5 shows jet fuel with water droplets at the bottom of the container (see Example 4).

FIG. 5 shows jet fuel with water droplets at the bottom of the container. The solution is clear/transparent.

Figure 6:
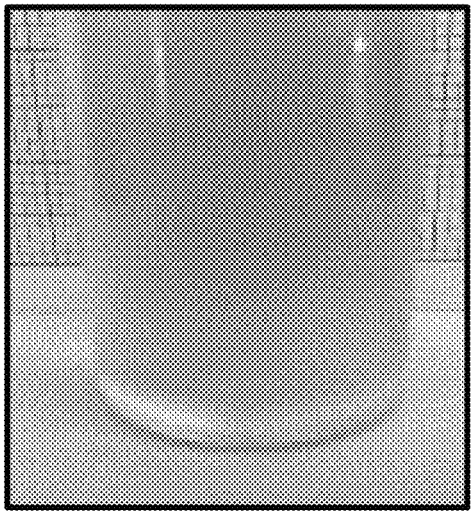
FIG. 6 shows the fuel after 17 ml of the additive system has been added (see Example 4).

FIG. 6 shows the fuel after 17 ml of the additive system has been added. The solution is hazy.

Figure 7:
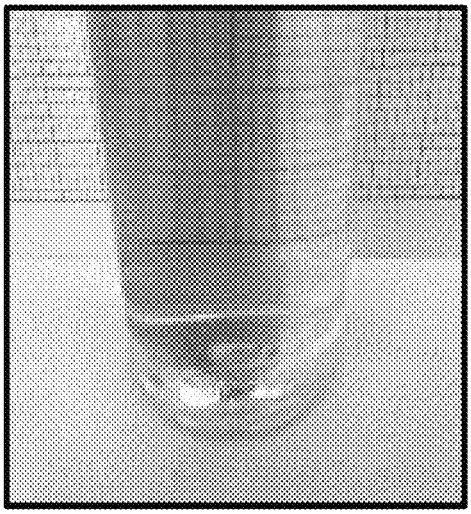
FIG. 7 shows the fuel after 19.4 ml of the additive system has been added (see Example 4).

FIG. 7 shows the fuel after 19.4 ml of the additive system has been added. The solution is clear/transparent.

Example 5

The recovered liquid from Example 3 was also used to prepare a second additive system for another fuel additive as described in GB 2463030 B.

Example 6

The additive system prepared in Example 5 was tested using the 1% volume water titration test and compared to an additive system from Example 5 using a version of the SURFAC™ UN30 surfactant that was not thermally cycled and filtered.

The additive system using the thermally cycled SURFAC™ UN30 alcohol ethoxylate reduced the quantity of additive required by 9% volume.

Example 7

The additive system prepared in Example 5 was tested using the 1% volume water titration test and compared to an additive system from Example 5 using a version of the SYNPERONIC™ 91-2.5 surfactant that was not thermally cycled and filtered.

The additive system using the thermally cycled SYNPERONIC™ 91-2.5 alcohol ethoxylate reduced the quantity of additive required by 9.4% volume.

Water Titration Test Protocol

1% volume water titration test is a standard test for examining the emulsification capacity of a surfactant system.

Place 99 ml of jet fuel into a suitable container such as a 250 ml conical flask with a magnetic stirrer set at rpm or value (5). In order to maintain consistency of results the magnetic stirrer should be used at a set rpm or value (0-9) on the equipment.

Add 1 ml water.

From a burette add the fuel additive system in aliquots of 1 ml allowing 30 seconds between each addition. As with any type of titration, drop wise additions are carried out once the end point is near.

The fluid in the container will become a white opaque emulsion. Continue to add the additive system until the fluid clears i.e. becomes transparent and free of haze. The results are taken from an average of 3 tests.

To check the clarity of the final fluid, samples of the fuel can be placed into a quartz cuvette and the % transmission of light can be measured at a given wavelength using a spectrophotometer or colorimeter.

The invention claimed is:

1. A method of improving the emulsification performance of nonionic alkoxylated surfactants in a fuel additive composition, said method comprising, prior to the addition of said fuel additive composition to an aircraft fuel, the steps of:

a) providing a composition comprising at least one nonionic alkoxylated surfactant; and b) thermally cycling said composition by (i) chilling the composition from a first temperature of 30° C. to 10° C. to a second temperature of 20° C. to −60° C. that causes metal ions and/or associated ions contained therein to precipitate as ionic salts, wherein the thermal cycling comprises from 2 to 15 cycles of heating and chilling; (ii) filtering the chilled composition to remove the precipitated ionic salts; and (iii) heating the filtered composition to the first temperature.

2. The method of claim 1, wherein the at least one nonionic alkoxylated surfactant is at least one nonionic ethoxylated surfactant.

3. The method of claim 2, wherein the at least one nonionic alkoxylated surfactant is at least one $C_6$-$C_{15}$-alkanol ethoxylate.

4. The method of claim 2, wherein the at least one nonionic alkoxylated surfactant is selected from $C_6$-alkanol ethoxylates, $C_7$-alkanol ethoxylates, a $C_8$-alkanol ethoxylates, $C_9$-alkanol ethoxylates, $C_{10}$-alkanol ethoxylates, $C_{11}$-alkanol ethoxylates, $C_{12}$-alkanol ethoxylates, $C_{13}$-alkanol ethoxylates, $C_{14}$-alkanol ethoxylates, and $C_{15}$-alkanol ethoxylates.

5. The method of claim 1, wherein the at least one $C_6$-$C_{15}$-alkanol ethoxylate is one $C_6$-$C_{15}$-alkanol ethoxylate selected from $C_6$-alkanol ethoxylates, $C_7$-alkanol ethoxylates, $C_8$-alkanol ethoxylates, $C_9$-alkanol ethoxylates, $C_{10}$-alkanol ethoxylates, $C_{11}$-alkanol ethoxylates, $C_{12}$-alkanol ethoxylates, $C_{13}$-alkanol ethoxylates, $C_{14}$-alkanol ethoxylates, and $C_{15}$-alkanol ethoxylates.

6. The method of claim 1, wherein the at least one nonionic alkoxylated surfactant is a mixture of $C_6$-$C_{15}$-alkanol ethoxylates with different carbon numbers for the alkanol unit species and 2 to 5 moles of ethylene oxide units on average per mole of alkanol, wherein the carbon numbers for the two $C_6$-$C_{15}$-alkanol ethoxylates which have the highest share in weight in the mixture being at least 1.5 carbon numbers distant from each other, and wherein the carbon number for one of the two $C_6$-$C_{15}$-alkanol ethoxylates which have the highest share in weight in the mixture is in the range of 9 to 11 and the other is in the range of 12 to 14.

7. The method of claim 1, wherein the thermal cycling comprises from 2 to 5 cycles of heating and chilling.

8. The method of claim 1, wherein the thermal cycling comprises from 6 to 10 cycles of heating and chilling.

9. The method of claim 1, wherein the thermal cycling comprises from 11 to 15 cycles of heating and chilling.

10. The method of claim 1, wherein in step (b) the first temperature is ambient temperature.

11. The method of claim 1, wherein in step (b) the second temperature is from 10° C. to −40° C.

12. The method of claim 11, wherein in step (b) the second temperature is from 0° C. to −20° C.

13. The method of claim 1, wherein in step (c) the chilled composition comprising at least one nonionic alkoxylated surfactant is filtered through a filter having a mesh size of less than 150 microns.

14. The method of claim 13, wherein the chilled composition is filtered through a filter having a mesh size of less than 25 microns.

15. The method of claim 14, wherein the chilled composition is filtered through a filter having a mesh size of less than 10 microns.

* * * * *